US011272596B2

(12) United States Patent
Lee

(10) Patent No.: US 11,272,596 B2
(45) Date of Patent: Mar. 8, 2022

(54) LED CONSTANT-CURRENT DRIVER CIRCUIT

(71) Applicant: DONGGUAN GATEWAY PLASTIC AND HARDWARE LIGHTING CO., LTD., Dongguan (CN)

(72) Inventor: James Lee, Dongguan (CN)

(73) Assignee: DONGGUAN GATEWAY PLASTIC AND HARDWARE LIGHTING CO., LTD., Dongguan (CN)

( * ) Notice: Subject to any disclaimer, the term of this patent is extended or adjusted under 35 U.S.C. 154(b) by 0 days.

(21) Appl. No.: 17/320,238

(22) Filed: May 14, 2021

(65) Prior Publication Data

US 2021/0274614 A1 Sep. 2, 2021

(51) Int. Cl.
*H05B 45/32* (2020.01)
*H05B 45/345* (2020.01)
*H05B 45/325* (2020.01)

(52) U.S. Cl.
CPC ..... *H05B 45/345* (2020.01); *H05B 45/325* (2020.01)

(58) Field of Classification Search
CPC ..... H05B 45/00; H05B 45/32; H05B 45/325; H05B 45/345; H05B 47/00
See application file for complete search history.

(56) References Cited

U.S. PATENT DOCUMENTS

2016/0198533 A1* 7/2016 Williams ..... H05B 45/3725 315/185 R

* cited by examiner

*Primary Examiner* — Jimmy T Vu

(57) ABSTRACT

The present disclosure relates to the technical field of LED light control, and in particular to an LED constant-current driver circuit. According to the LED constant-current driver circuit of the present disclosure, by connecting driver modules together in series, when a voltage is input, the input voltage is distributed to each driver module. Thus, different ranges of voltages can be input, and the attenuation of the input voltage is reduced, increasing the reliability of the system. Moreover, the overall structure is simple, reducing the cost of the product.

7 Claims, 3 Drawing Sheets

LED CONSTANT-CURRENT DRIVER CIRCUIT

TECHNICAL HELD

The present disclosure relates to the technical field of LED light control, and in particular to an LED constant-current driver circuit.

BACKGROUND

At present, as the governments all over the world have reached a consensus on energy saving and environment protection, there will be a tremendous potential in the prospect and development of industries related to environment protection and energy saving in the future, and the LED semiconductor technology adopted in popular industries will become one of the most promising high-tech fields. The development of the semiconductor technology and industries is much faster than expected. Some characteristics of LED light sources, such as rich colors, high color saturation, concentrated beam, solid-state lighting, fast response and digitalized, intelligentized and networked control and adjustment of brightness and color, are unmatched by any artificial light sources in the past. In the field of LED landscape lighting, with the characteristics of high reliability, long service life, high environmental adaptability, high cost performance, low cost in use, etc., strip lights, LED strips, guardrail tubes and the like composed of light-emitting diodes have become mainstream products for building decoration and shop decoration in just a few years.

With the development of the LED driving technology, the requirement on LED landscape lighting is getting higher and higher. The high-voltage series-connected chips available in the market adopt a constant-voltage mode, so voltage fluctuation will cause a change in the current of LED lights. Among conventional constant-current LED circuit systems, for example, in an LED driver circuit system, as shown in FIG. 1, the input voltage of a chip is decreased through the series connection of LEDs, the number of the LEDs connected in series depends on an input voltage VIN. DATA controls the LED display duty cycle through the DIN port of the chip, and this solution has a defect that the display duty cycle of each LED light cannot be controlled separately. In another LED driver circuit system, as shown in FIG. 2, the display of each LED is controlled through DATA, but the defects of this solution are that different power input voltages cannot be achieved and voltage attenuation in this solution is great. To sum up, there are problems in existing technology that different power input voltages cannot be achieved and voltage attenuation in this solution is great in LED driver circuits.

SUMMARY

To solve the aforementioned problems, the present disclosure provides an LED constant-current driver circuit, which is intended to solve the problems in existing technology that different power input voltages cannot be achieved and voltage attenuation is great in LED driver circuits.

In order to achieve the aforementioned objective, the technical scheme adopted by the present disclosure is as follows: an LED constant-current driver circuit includes a plurality of driver modules, the number of the plurality of driver modules is n, which is a positive integer greater than 1, a power input end of a first driver module is connected to an input power supply, a data input end of the first driver module receives data frames, where a power output end of the first driver module is connected to a power input end of a second driver module, and a data output end of the first driver module is connected to a data input end of the second driver module, and the second to a $n_{th}$ driver modules are connected stage by stage in series; each series-connected driver module divides the voltage of the input power supply to obtain a working voltage, and outputs the voltage to a next driver module connected therewith; the first driver module acquires display data of a current stage, and sends a data frame to the second driver module; the second driver module performs level conversion on the data frame output by the first driver module according to the input voltage of the data frame to obtain a recognizable data frame, extracts corresponding current stage display data from the recognizable data frame, and sends a data frame to the third driver module, and this process is performed stage by stage in series until the $n_{th}$ driver module; and each driver module controls an LED light therein to display according to the corresponding current stage display data, so that the current flowing through the LED light can be kept constant when the LED light is switched on, and a difference between the voltage of the power input end and the voltage of the power output end is kept constant when the LED light is switched on and off.

Further, each of the driver modules includes an LED light and a driver chip; an anode of the LED light is connected to a power input end of the driver chip and forms a power input end of the driver module, a cathode of the LED light is connected to a control signal output end of the driver chip, a ground end of the driver chip is a power output end of the driver module, a data input end of the driver chip is a data input end of the driver module, and a data output end of the driver chip is a data output end of the driver module; and the driver chip controls the LED light connected therewith to display according to corresponding current stage display data, so that the current flowing through the LED light can be kept constant when the LED light is switched on, and the difference between the voltage of the power input end and the voltage of the power output end is kept constant when the LED light is switched on and off.

In an embodiment, the driver chip includes a constant-current driver module and a decoding module; an input end of the decoding module is the data input end of the driver chip, a first output end of the decoding module is the data output end of the driver chip, and a second output end of the decoding module is connected to a control end of the constant-current driver module; the decoding module extracts corresponding current stage display data from the data frame, sends a data frame to a next driver module, decodes the current stage display data, and sends the decoded display data to the constant-current driver module; and the constant-current driver module controls the LED light connected therewith to display according to the decoded display data, so that the current flowing through the LED light can be kept constant when the LED light is switched on.

In an embodiment, the driver chip includes a voltage regulator module, where an input end of the voltage regulator module is the power input end of the driver chip and an output end of the voltage regulator module is the power output end of the driver chip; and the voltage regulator module is configured to keep the difference between the voltage of the power input end and the voltage of the power output end constant when the LED light is switched on and off.

In an embodiment, the decoding module includes a signal sampling module, a PWM scanning module, and a shaping and regeneration module; the signal sampling module is configured to collect a data frame and perform level conversion on the data frame to obtain a recognizable data frame; the PWM scanning module is configured to extract and decode current stage display data from the recognizable data frame, send the decoded display data to the constant-current driver module and send the data frame to the shaping and regeneration module; and the shaping and regeneration module is configured to shape the data frame and send it to a next driver module.

In an embodiment, the decoding module includes a signal sampling module, an internal control/external control judgment module, a PWM scanning module, and a shaping and regeneration module; the signal sampling module is configured to collect a data frame and perform level conversion on the data frame to obtain a recognizable data frame; the internal control/external control judgment module is configured to judge whether a data frame is received or not; if yes, corresponding current stage display data is extracted from the received data frame and sent to the PWM scanning module, and if no, the current stage display data is obtained according to data provided by a built-in effect algorithm and sent to the PWM scanning module; the PWM scanning module is configured to extract and decode the current stage display data from the recognizable data frame, send the decoded display data to the constant-current driver module and send the data frame to the shaping and regeneration module; and the shaping and regeneration module is configured to shape the data frame and send it to a next driver module.

In an embodiment, the decoding module further includes a first signal transmission line and a second signal transmission line; and the decoding module acquires a differential data frame based on the first signal transmission line and the second signal transmission line, extracts corresponding current stage display data from the differential data frame, and sends the differential data frame to a next driver module.

The advantages of the present disclosure are as follows: according to the LED constant-current driver circuit of the present disclosure, by connecting driver modules together in series, when a voltage is input, the input voltage is distributed to each driver module. Thus, different ranges of voltages can be input, and the attenuation of the input voltage is reduced, increasing the reliability of the system. Moreover, the overall structure is simple, reducing the cost of the product.

DETAILED DESCRIPTION

The present disclosure will be further described in detail hereinafter by way of specific embodiments in combination with the drawings. The present application can be implemented in a variety of forms, and is not limited to the implementations described in the embodiments.

Figure 1:
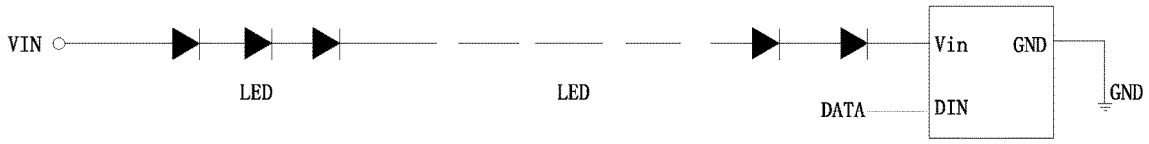
FIG. 1 is a schematic structural diagram of an LED constant-current driver circuit in existing technology.
Figure 2:
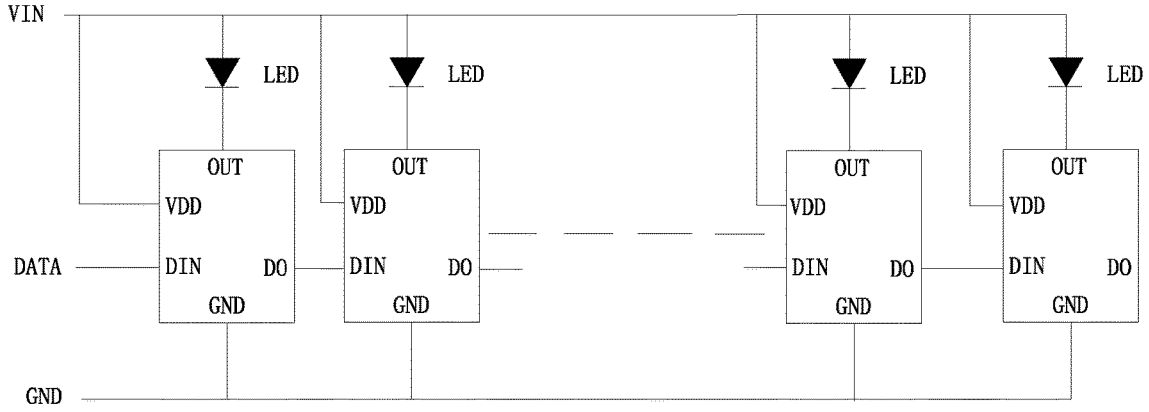
FIG. 2 is a schematic structural diagram of another LED constant-current driver circuit in existing technology.
Figure 3:
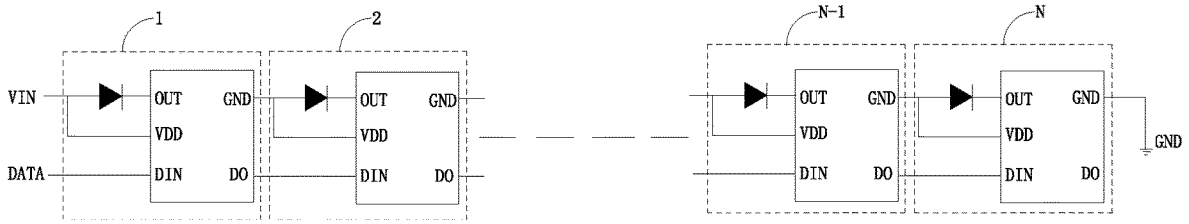
FIG. 3 is a schematic structural diagram of an LED constant-current driver circuit provided by the present disclosure.

Referring to FIGS. 1-6, the present disclosure relates to an LED constant-current driver circuit. As shown in FIG. 3, the LED constant-current driver circuit includes a plurality of (1, 2 to N) driver modules. The number of the plurality of driver modules is n, which is a positive integer greater than 1. A power input end of a first driver module 1 is connected to an input power supply, and a data input end of the first driver module 1 receives data frames.

A power output end of the first driver module 1 is connected to a power input end of a second driver module 2, and a data output end of the first driver module 1 is connected to a data input end of the second driver module 2, and the second 2 to a $n_{th}$ driver modules are connected stage by stage in series.

Each series-connected driver module divides the voltage of the input power supply to obtain a working voltage, and outputs the voltage to a next driver module connected therewith.

The first driver module 1 acquires current stage display data, and sends a data frame to the second driver module 2.

The second driver module 2 performs level conversion on the data frame output by the first driver module 1 according to the input voltage of the data frame to obtain a recognizable data frame, extracts corresponding current stage display data from the recognizable data frame, and sends the data frame to a third driver module, and this process is performed stage by stage in series until the $n_{th}$ driver module N. Each driver module controls an LED light therein to display according to the corresponding current stage display data, so that the current flowing through the LED light can be kept constant when the LED light is switched on, and a difference between the voltage of the power input end and the voltage of the power output end is kept constant when the LED light is switched on and off.

According to the LED constant-current driver circuit of the present disclosure, by connecting the driver modules together in series, when a voltage is input, the input voltage is distributed to each driver module. Thus, different ranges of voltages can be input, and the attenuation of the input voltage is reduced, increasing the reliability of the system. Moreover, the overall structure is simple, reducing the cost of the product.

Specifically, each of the driver modules includes an LED light and a driver chip. An anode of the LED light is connected to a power input end of the driver chip and forms a power input end of the driver module, and a cathode of the LED light is connected to a control signal output end of the driver chip. A ground end of the driver chip is a power output end of the driver module, a data input end of the driver chip is a data input end of the driver module, and a data output end of the driver chip is a data output end of the driver module.

The driver chip controls the LED light connected therewith to display according to the corresponding current stage display data, so that the current flowing through the LED light can be kept constant when the LED light is switched on, and the difference between the voltage of the power input end and the voltage of the power output end is kept constant when the LED light is switched on and off.

Figure 4:
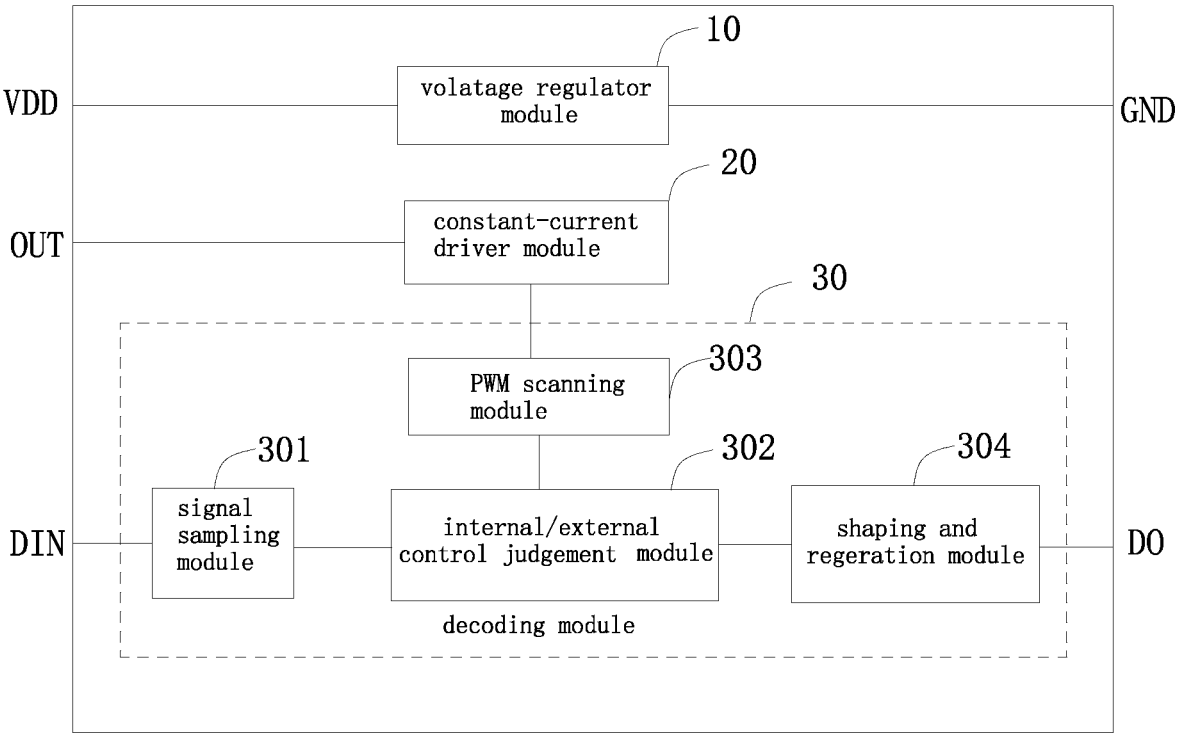
FIG. 4 is a schematic structural diagram of a driver chip in a driver module in the LED constant-current driver circuit provided by the present disclosure.

Specifically, as shown in FIG. 4, the driver chip includes a constant-current driver module 20 and a decoding module 30;

An input end of the decoding module 30 is the data input end of the driver chip, a first output end of the decoding module 30 is the data output end of the driver chip, and a second output end of the decoding module 30 is connected with a control end of the constant-current driver module 20.

The decoding module 30 extracts corresponding current stage display data from a data frame, sends the data frame to a next driver module, decodes the current stage display data, and sends the decoded display data to the constant-current driver module 20.

According to the decoded display data, the constant-current driver module 20 controls the LED light connected therewith to display, so that the current flowing through the LED light is kept constant when the light is switched on.

In an implementation, the driver chip in the first driver module receives a DATA signal, extracts first data through the built-in decoding module 30, and sends out the remaining data through a DO port, and the same holds for the other driver chips. In another implementation, the driver chip in the first driver module receives a DATA signal, extracts first data through the built-in decoding module 30, and sends out all the data through the DO port, and the same holds for the other driver chips.

The decoding module 30 decodes the data, converts the data into a control signal for controlling the on-off of the LED at an OUT port, and sends the control signal to the constant-current driver module 20, so that the current will not change as the voltage changes when the OUT port is switched on.

Further, the driver chip further includes a voltage regulator module 10. An input end of the voltage regulator module is the power input end of the driver chip and an output end of is the voltage regulator module is the power output end of the driver chip.

The voltage regulator module 10 is configured to keep the difference between the voltage of the power input end and the voltage of the power output end constant when the LED light is switched on and off.

Preferably, by calculating the number of the driver chips, the voltage regulator module 10 can evenly distribute the input voltage to each driver chip.

Specifically, as an implementation of the decoding module 30, the decoding module 30 includes a signal sampling module 301, a PWM scanning module 303, and a shaping and regeneration module 304.

The signal sampling module 301 is configured to collect a data frame and perform level conversion on the data frame to obtain a recognizable data frame.

Specifically, because each driver chip divides the input voltage, the input level of each driver chip is different. As a result, the next driver chip needs to perform level conversion on the data frame output by a previous driver chip according to its own input level, so that the driver chip can recognize the received data frame.

The PWM scanning module 303 is configured to extract and decode the current stage display data from the recognizable data frame, send the decoded display data to the constant-current driver module 20 and send the data frame to the shaping and regeneration module 304.

The shaping and regeneration module 304 is configured to shape the data frame and send it to a next driver module.

Specifically, as another implementation of the decoding module 30, the decoding module 30 includes a signal sampling module 301, an internal control/external control judgment module 302, a PWM scanning module 303 and a shaping and regeneration module 304.

The signal sampling module 301 is configured to collect a data frame and perform level conversion on the data frame to obtain a recognizable data frame.

Specifically, because each driver chip divides the input voltage, the input level of each driver chip is different. As a result, the next driver chip needs to perform level conversion on the data frame output by a previous driver chip according to its own input level, so that the driver chip can recognize the received data frame.

The internal control/external control judgment module 302 is configured to judge whether a data frame is received; if yes, corresponding current stage display data is extracted from the received data frame and sent to the PWM scanning module 303, and if no, the current stage display data is obtained according to data provided by a built-in effect algorithm and sent to the PWM scanning module 303.

The PWM scanning module 303 is configured to extract and decode the current stage display data from the recognizable data frame, send the decoded display data to the constant-current driver module and send the data frame to the shaping and regeneration module 304.

The shaping and regeneration module 304 is configured to shape the data frame and send it to the next driver module.

Figure 5:
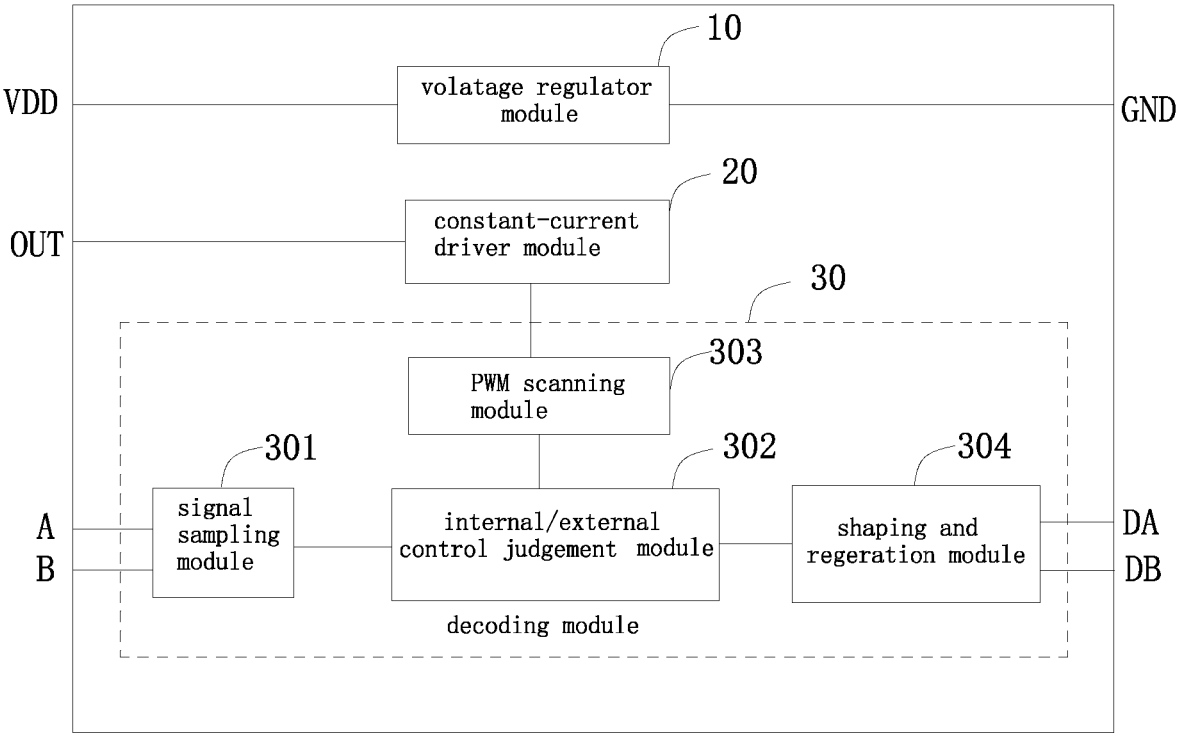
FIG. 5 is a schematic structural diagram of another embodiment of the driver chip in the driver module in the LED constant-current driver circuit provided by the present disclosure.

Further, as shown in FIG. 5, as another implementation, the decoding module 30 includes a first signal transmission line and a second signal transmission line.

The decoding module 30 acquires a differential data frame based on the first signal transmission line and the second signal transmission line, extracts corresponding current stage display data from the differential data frame, combines and encodes the rest of the display data into a differential data frame, and sends the differential data frame to a next driver module.

Specifically, the first signal transmission line and the second signal transmission line input data signals with opposite levels. The decoding module compares the two data signals to obtain a data frame, extracts corresponding current stage display data, combines and encodes the rest of the display data into a differential data frame, and sends it to the next driver module.

Figure 6:
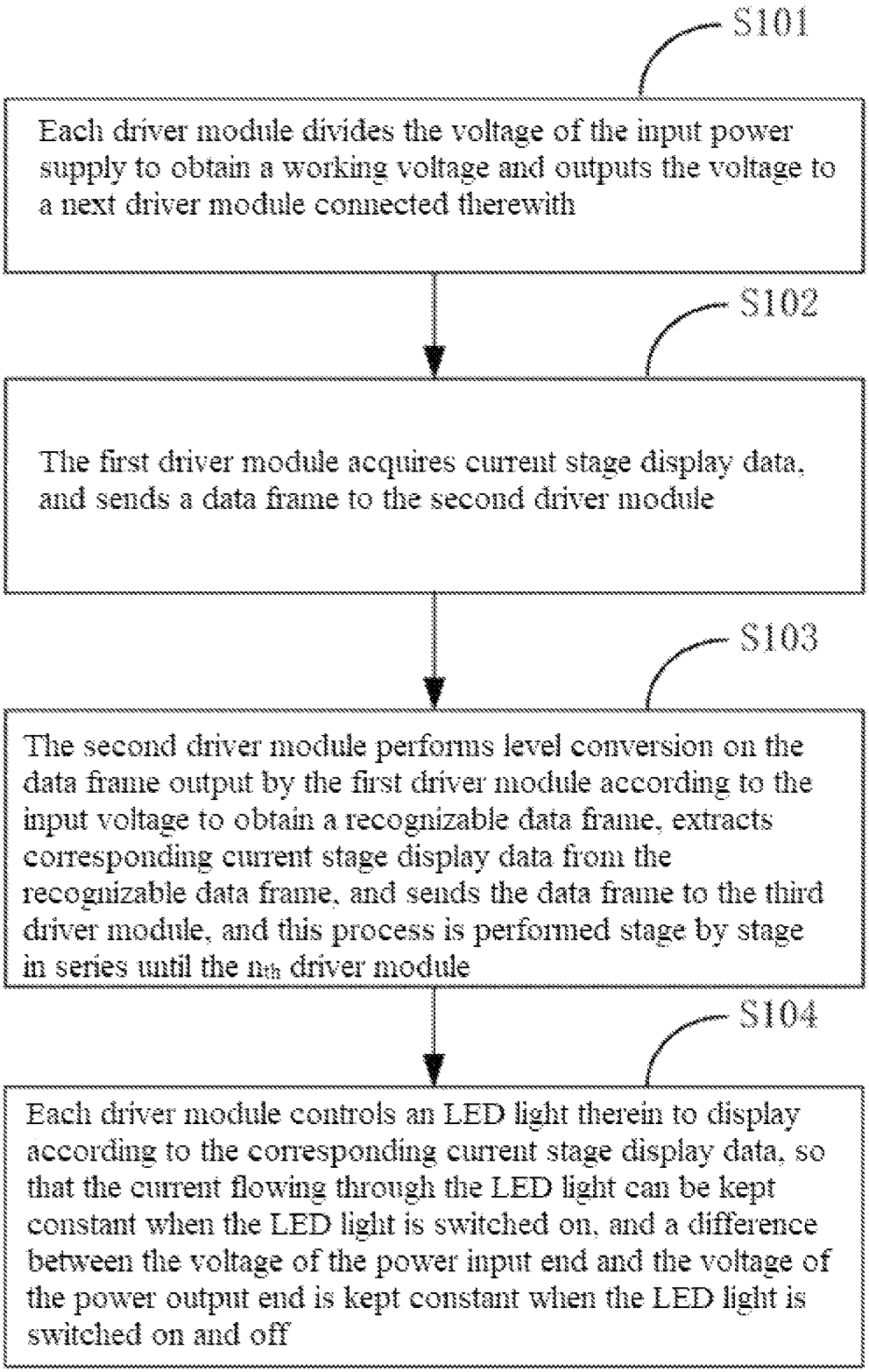
FIG. 6 is a flow chart of a control method for the LED constant-current driver circuit provided by the present disclosure.

Another embodiment of the present disclosure provides a control method for the LED constant-current driver circuit. As shown in FIG. 6, the LED constant-current driver circuit includes a plurality of driver modules. The number of the plurality of driver modules is n, which is a positive integer. A power input end of a first driver module 1 is connected to input power supply, and a data input end of the first driver module 1 receives data frames.

The control method includes the following steps S101 to S104.

At step S101, each of the driver modules divides the voltage of the input power supply to obtain a working voltage, and outputs the voltage to a next driver module connected therewith.

At step S102, the first driver module acquires current stage display data, and sends a data frame to the second driver module.

At step S103, the second driver module performs level conversion on the data frame output by the first driver module according to the input voltage to obtain a recognizable data frame, extracts corresponding current stage display data from the recognizable data frame, and sends the data frame to the third driver module, and this process is performed stage by stage in series until the $n_{th}$ driver module.

At step S104, each driver module controls an LED light therein to display according to the corresponding current stage display data, so that the current flowing through the LED light can be kept constant when the LED light is switched on, and a difference between the voltage of the power input end and the voltage of the power output end is kept constant when the LED light is switched on and off.

Specifically, at step S102, the first driver module 1 obtaining the current stage display data includes step S1031 to S1033.

At step S1031, the first driver module 1 judges whether a data frame is received; if yes, step S1032 is executed, and if no, step S1033 is executed.

At step S1032, the corresponding current stage display data is extracted from the received data frame.

At step S1033, the current stage display data is obtained according to data provided by a built-in effect algorithm.

Specifically, the driver chip in the driver module of the LED driver circuit judges whether the chip works in an external controller-controlled state or a built-in automatic display effect state. If the input port DIN of the driver chip receives data within a period of time, it is determined that the driver chip is in the external controller-controlled state, and if no data is received, it is determined that the driver chip is in the built-in automatic display effect state.

If the driver chip works in the external controller-controlled state, the driver chip extracts data corresponding to the driver chip in a data frame provided by an external controller, and transmits the remainder of the data frame; and if the driver chip works in the built-in automatic display effect state, the driver chip extracts data according to data provided by the built-in effect algorithm, and provides the data of the built-in effect algorithm to a next driver chip.

According to the extracted data, the driver chip controls the LED light connected therewith to display, achieving a desired display effect.

In order to facilitate the understanding of the present disclosure, the implementation method of the present disclosure will be illustrated by way of an example.

As shown in FIG. 3, the input voltage VIN is 300V, and a total of 60 driver chips are connected in series. When an OUT port of each of the driver chips is switched on, the current is 12 mA, and after the system is stable, the difference between the voltage of a VIM port and the voltage of a GND port in each driver chip is about 300/60=5V. Taking the first driver chip as an example, a DIN port of each driver chip receives data DATA, extracts first data, and sends out the remaining data via a DO port. If it is assumed that the first data is a signal with a duty cycle of 50%, after a reset signal is received, the OUT port of the first driver chip is switched on and off at a certain frequency and a duty cycle of 50% until a next data and reset signal come.

Specifically, at step S1032, a differential transmission mode is adopted to receive the data frame.

A first signal transmission line and a second signal transmission line are adopted to input data signals with opposite levels. The two data signals are compared to obtain a data frame, corresponding current stage display data is extracted, and the rest of the display data are combined and encoded into a differential data frame, which is sent to a next driver module.

At step S104, specifically, because each driver chip divides the input voltage, the input level of each driver chip is different. As a result, a next driver chip needs to perform level conversion on the data frame output by the previous driver chip according to its own input level, so that the driver chip can recognize the received data frame.

Specifically, by calculating the number of the driver chips, the input voltage can be evenly distributed to each driver chip, and the difference between the voltage of the power input end and the voltage of the power output end in a power module can be kept constant.

It should be further explained that, unless otherwise specified and defined clearly, the terms used such as "connect", "fix" and "arrange", should be understood in a broad sense, and for those having ordinary skills in the art, the specific meanings of the aforementioned terms in the present disclosure can be understood according to specific conditions.

The above embodiments only describe the preferred embodiments of the present disclosure rather than limit the scope of the present disclosure. Various modifications and improvements which are made by those having ordinary skills in the art to the technical scheme of the present disclosure without departing from the design spirit of the present disclosure shall fall within the protection scope defined by the claims of the present disclosure.

The invention claimed is:

1. An LED constant-current driver circuit, comprising a plurality of driver modules, the number of the plurality of driver modules being n which is a positive integer greater than 1, wherein a power input end of a first driver module is connected to an input power supply, and a data input end of the first driver module receives data frames, and wherein a power output end of the first driver module is connected to a power input end of a second driver module, and a data output end of the first driver module is connected to a data input end of the second driver module, and the second to a $n_{th}$ driver modules are connected stage by stage in series; each series-connected driver module divides the voltage of the input power supply in series to obtain a working voltage, and outputs the voltage to a next driver module connected therewith; the first driver module acquires display data of a current stage, and sends a data frame to the second driver module; the second driver module performs level conversion on the data frame output by the first driver module according to the input voltage of the data frame to obtain a recognizable data frame, extracts corresponding current stage display data from the recognizable data frame, and sends a data frame to the third driver module, and this process is performed stage by stage in series until the $n_{th}$ driver module; and each driver module controls an LED light therein to display according to the corresponding current stage display data, so that the current flowing through the LED light can be kept constant when the LED light is switched on, and a difference between the voltage of the power input end and the voltage of the power output end is kept constant when the LED light is switched on and off.

2. The LED constant-current driver circuit of claim 1, wherein each of the driver modules comprises an LED light and a driver chip; an anode of the LED light is connected to a power input end of the driver chip and forms a power input end of the driver module, a cathode of the LED light is connected to a control signal output end of the driver chip, a ground end of the driver chip is a power output end of the driver module, a data input end of the driver chip is a data input end of the driver module, and a data output end of the driver chip is a data output end of the driver module; and the driver chip controls the LED light connected therewith to display according to the corresponding current stage display data, so that the current flowing through the LED light can be kept constant when the LED light is switched on, and the difference between the voltage of the power input end and the voltage of the power output end is kept constant when the LED light is switched on and off.

3. The LED constant-current driver circuit of claim 2, wherein the driver chip comprises a constant-current driver module and a decoding module; an input end of the decoding module is a data input end of the driver chip, an first output end of the decoding module is a data output end of the driver chip, and a second output end of the decoding module is connected to a control end of the constant-current driver module; the decoding module extracts the corresponding current stage display data from the data frame, sends a data frame to a next driver module, decodes the current stage display data, and sends the decoded display data to the constant-current driver module; and the constant-current driver module controls the LED light connected therewith to display according to the decoded display data, so that the current flowing through the LED light can be kept constant when the LED light is switched on.

4. The LED constant-current driver circuit of claim 2, wherein the driver chip comprises a voltage regulator module, an input end of the voltage regulator module is the power input end of the driver chip and an output end of the voltage regulator module is the power output end of the driver chip; and the voltage regulator module is configured to keep the difference between the voltage of the power input end and the voltage of the power output end constant when the LED light is switched on and off.

5. The LED constant-current driver circuit of claim 3, wherein the decoding module comprises a signal sampling module, a PWM scanning module, and a shaping and regeneration module; the signal sampling module is configured to collect a data frame and perform level conversion on the data frame to obtain a recognizable data frame; the PWM scanning module is configured to extract and decode the current stage display data from the recognizable data frame, send the decoded display data to the constant-current driver module and send the data frame to the shaping and regeneration module; and the shaping and regeneration module is configured to shape the data frame and send it to a next driver module.

6. The LED constant-current driver circuit of claim 3, wherein the decoding module comprises a signal sampling module, an internal control/external control judgment module, a PWM scanning module, and a shaping and regeneration module; the signal sampling module is configured to collect a data frame and perform level conversion on the data frame to obtain a recognizable data frame; the internal control/external control judgment module is configured to judge whether a data frame is received or not; if yes, the corresponding current stage display data is extracted from the received data frame and sent to the PWM scanning module, and if no, the current stage display data is obtained according to data provided by a built-in effect algorithm and sent to the PWM scanning module; the PWM scanning module is configured to extract and decode the current stage display data from the recognizable data frame, send the decoded display data to the constant-current driver module and send the data frame to the shaping and regeneration module; and the shaping and regeneration module is configured to shape the data frame and send it to a next driver module.

7. The LED constant-current driver circuit of claim 3, wherein the decoding module further comprises a first signal transmission line and a second signal transmission line; and the decoding module acquires a differential data frame based on the first signal transmission line and the second signal transmission line, extracts corresponding current stage display data from the differential data frame, and sends the differential data frame to the next driver module.

* * * * *